US006742515B2

(12) United States Patent
Maier

(10) Patent No.: US 6,742,515 B2
(45) Date of Patent: Jun. 1, 2004

(54) AIR EXTRACTION DEVICE FOR A WORKPLACE

(76) Inventor: Max Maier, Rheinlandstrasse 10, Ludwigsburg (DE), 71636

( * ) Notice: Subject to any disclaimer, the term of this patent is extended or adjusted under 35 U.S.C. 154(b) by 0 days.

(21) Appl. No.: 10/019,106

(22) PCT Filed: Apr. 19, 2001

(86) PCT No.: PCT/EP01/04469

§ 371 (c)(1),
(2), (4) Date: Jun. 3, 2002

(87) PCT Pub. No.: WO01/81831

PCT Pub. Date: Nov. 1, 2001

(65) Prior Publication Data

US 2003/0101986 A1 Jun. 5, 2003

(30) Foreign Application Priority Data

Apr. 20, 2000 (DE) ..... 100 19 702

(51) Int. Cl.[7] ..... F24B 13/00

(52) U.S. Cl. ..... 126/299 R; 126/299 D; 55/DIG. 36

(58) Field of Search ..... 126/299 R, 299 D; 55/DIG. 36; 454/56, 61

(56) References Cited

U.S. PATENT DOCUMENTS

| | | | | |
|---|---|---|---|---|
| 3,002,584 A | * | 10/1961 | Jerabek | 96/138 |
| 3,131,688 A | * | 5/1964 | Lipstein | 126/299 R |
| 3,260,189 A | | 7/1966 | Jensen | |
| 3,328,560 A | * | 6/1967 | Dills | 219/391 |
| 3,381,453 A | * | 5/1968 | Dills | 96/136 |
| 6,058,924 A | * | 5/2000 | Pool et al. | 126/21 A |

FOREIGN PATENT DOCUMENTS

| | | |
|---|---|---|
| DE | 473883 | 3/1929 |
| DE | 1742985 | 4/1957 |
| DE | 2402615 | 7/1975 |
| DE | 2815771 | 10/1979 |
| FR | 2619198 | 2/1989 |
| FR | 2698158 | 5/1994 |

OTHER PUBLICATIONS

Bohner Co.; SMOG–STOPP catalog; Date unknown but believed to be during 2000, prior to the filing date of this application No English Translation.

Association for Promotion of Healthy Nourishment and Diet Cooking Practices & Community Care; Oct. 1999 No English Translation.

* cited by examiner

*Primary Examiner*—Alfred Basichas
(74) *Attorney, Agent, or Firm*—Volpe and Koenig, P.C.

(57) ABSTRACT

This invention relates to an air extraction device (12) for a work station (14), especially one where food is subjected to heat, for example a grill. One air inlet (36, 38) each is provided on each side of the work station (14), said inlets being connected to a fan (26) and a filter system (28) and communicating with them and with an area (42) disposed above the work station (14) in a closed air cycle (48) that produces an air blast (44) in said area. About 75% of the air are continuously discharged from the air cycle via an air discharge (50) so that only 25% of the air form the air blast (44). The discharged portion of the air is continuously replaced by taking in ambient air via the down-stream air inlet (38) and/or via a separate, additional air inlet (63). The filter system (28) is provided with a grease trap filter (30) upstream of the fan and an odor filter (32) downstream of the fan. The inventive air extraction device prevents odors and grease from reaching the surroundings of the work station and allows for a simple and unproblematic maintenance of the filters.

36 Claims, 9 Drawing Sheets

AIR EXTRACTION DEVICE FOR A WORKPLACE

Figure 1:
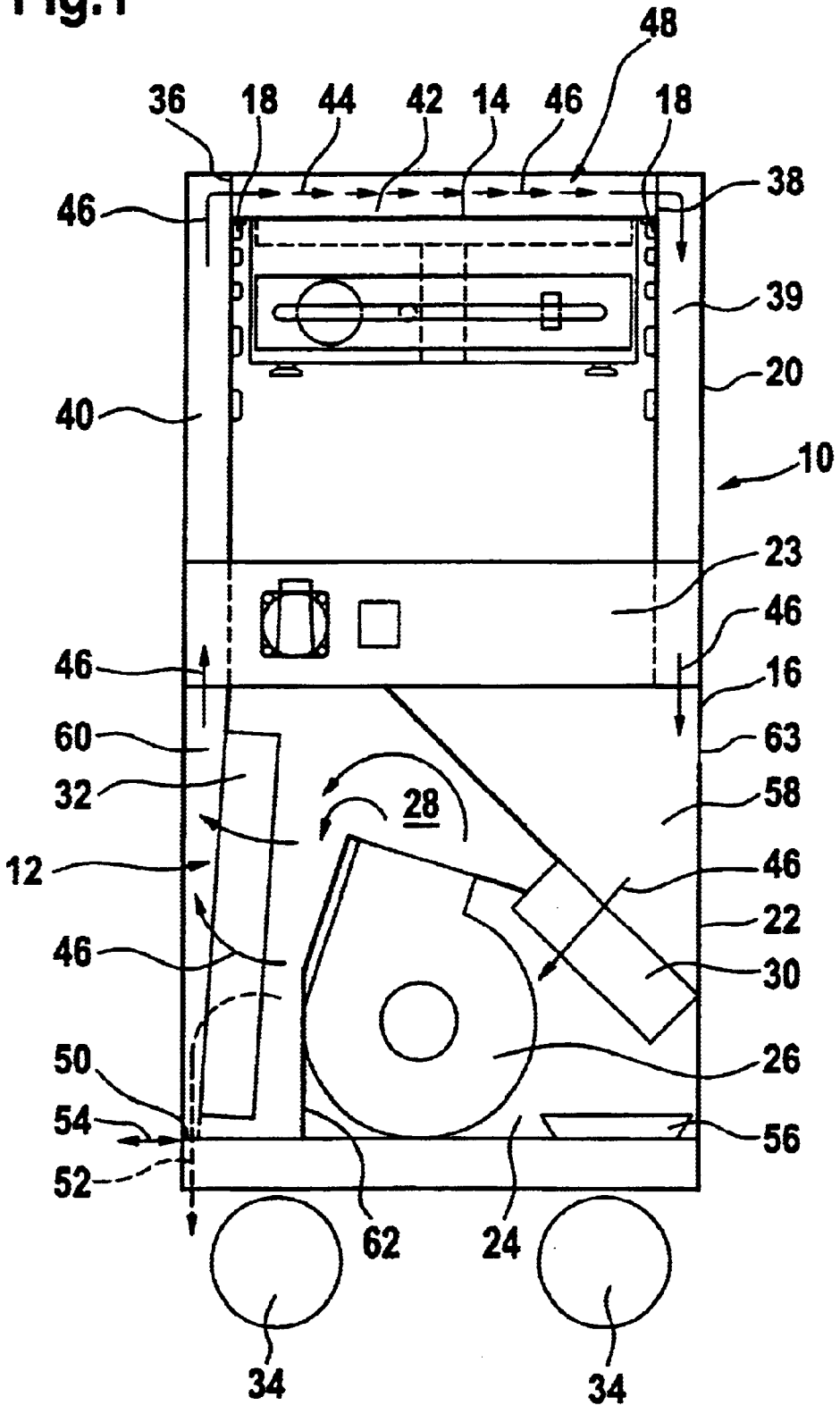

This invention relates to an air extraction apparatus of the kind defined in the preamble of claim 1.

These days, there often exists, in food service, and especially in food service systems and communal catering in cafeterias and the like, i.e. in situations in which the guests serve themselves, the requirement that cooking, grilling or baking be done right before the guest's eyes. In this so-called up-front cooking there exists the problem that the fumes which are created thereby have to be removed. Because stationary fume extraction hoods are often not available or suitable and transportable fume extraction hoods are often not available or applicable, there has already been developed a mobile cooking station (cf. the SMOKE-STOPP catalog of the Bohner Company for the year 2000) and a stationary kitchen module (cf. the article "Odorless Before The Eyes Of The Guests" in the magazine Cooking Practice and Community Food Supply, October 1999, page 52), which are provided with an air extraction apparatus of the kind defined in the preamble of claim 1. In the known air extraction apparatus which sometimes involve a grill, the two air openings on both sides of the work station serve for rim extraction. Because extraction is performed at both lateral rims of the work station, the extraction effect above the middle of the work station is naturally relatively slight. Therefore, a large area above the work surface is not efficiently encompassed by the air current drawn in at the rims. A particular disadvantage of rim extraction is that uncleansed room air is drawn partly across the work station. In addition, for integrated odor elimination, the known air extraction apparatus has, in a substructure below the work station, several pre-filters, several fabric filters and several activated carbon filters, between which there is located an exhausting device which provides bidirectional suction. The whole lower surface of the substructure is occupied by a grease-collecting pan. This filter arrangement requires work and is expensive, because the activated carbon filters have to be changed frequently and constitute an environmental burden.

Indeed, an odor extraction apparatus known from DE 2 402 615 A1 can make do with a simpler filter arrangement for grease separation and odor removal, but a suction funnel with a grease retention filter is positioned above the work station, and that requires an upwardly directed air flow in order to produce an air curtain for screening the work station.

From U.S. Pat. No. 3,260,189 there is known a ventilating system in which there is provided, above the work station, an extraction apparatus inclined diagonally with respect to the work station and provided with several grease filters. Air which exits on one side of the work station from a blower slot is thus guided over the work station diagonally upwardly to the extraction device. Furthermore, in this known ventilating system, no special precautions for odor elimination are taken.

The object of the invention is to so improve the extraction in an air extraction apparatus of the kind initially described that the extraction process effectively encompasses the whole work area and that food on the work station does not come into contact with uncleansed ambient air.

This object is achieved according to the invention by an air extraction apparatus having the characteristics stated in claim 1.

In the air extraction apparatus according to the invention, there is formed an air circulation loop which extends across the whole work station, above which it creates an air curtain. The air curtain is formed by air which flows out of an air opening on one side of the work station and flows into an air opening on the opposite side of the work station. Thus, the air curtain produced by the air extraction apparatus according to the invention covers the whole area above the work station. The air which forms the air curtain is ambient air, i.e. air which flows over the work station only after it has been drawn through the filter arrangement by means of the suction blower, and is therefore cleansed air. The compact housing of the blower and the filter arrangement in a separate space, located in the air circulation loop and connected to the air openings on both sides of the work station, makes it possible for the air extraction apparatus according to the invention to separate, within limited space inside the air loop, grease from the air and simultaneously free it from odors. In the air extraction apparatus according to the invention, the air to be cleansed is drawn in through the grease separating filter and pushed out through the odor filter. Since a grease separating filter and an odor filter have different pressure drops, the inventive arrangement of the two filters, respectively upstream and downstream of the blower, makes it possible to adjust the air velocity optimally for the respective filters.

Since, in the air extraction apparatus according to the invention, the air circulation loop provides an air outlet for a portion of the air from this air circulation loop, a portion of the air in the air circulation loop can be continuously replaced by ambient air which is then also led first through the filter arrangement before it contributes to the formation of the air curtain above the work station.

Because, in an air extraction apparatus according to the invention, the opening of the air outlet can also be adjusted in size, the fraction of fresh ambient air in the air circulation loop can be adjusted as needed. Further, because in the air extraction apparatus according to the invention, the air outlet is located downstream from the blower, the air has passed through the filter arrangement and is therefore already cleansed before it escapes into the ambient. Further, because in the air extraction apparatus according to the invention, the blower is located between at least two filters of the filter arrangement, the blower is protected from becoming dirty. Further, because the filter upstream from the blower is a grease separating filter and the filter downstream from the blower is an odor filter, the blower is especially little adversely affected by air loaded with grease and the ambient air which is led back to the work station is not only grease- but also odor-free.

Indeed, from DE 473883C it is in fact already known to provide, in a system for protecting work spaces from the vapors coming from open vessels and other air uncleanliness, by means of an air curtain, a blower which simultaneously serves to create the air flow and to remove the vapors, whose intake duct segment opens into a funnel located above the edge of a container, whereas its pressure duct segment has a nozzle at the opposite container edge directed toward the funnel from which an outlet duct branches off, but in this known apparatus there are no means at all for grease separation or odor elimination. The air outlet leads simply into open space.

Preferred embodiments of the air extraction apparatus according to the invention are the subject of the dependent claims.

If, in an embodiment of the air extraction apparatus according to the invention, the blower is a centrifugal blower, both structural and flow-technology advantages are achieved in the construction of the air extraction apparatus.

If, in a further embodiment of the air extraction apparatus according to the invention, the grease separating filter is a cyclone filter, as manufactured, for example by the Renchler & Reven Company, 99.5% of the grease entrained in the exhausted air can be separated. Further, such a filter is very maintenance friendly, because it can be simply washed out in a dishwasher and then reinstalled.

If, in a further embodiment of the air extraction apparatus according to the invention, a grease collecting pan is installed below the grease separating filter, the grease separated by the grease separating filter can be collected in simple manner.

If, in a further embodiment of the air extraction apparatus, the odor filter is a zeolite filter, then this odor filter can be easily re-generated and is therefore especially maintenance and environment friendly.

If, in a further embodiment of the air extraction apparatus according to the invention, the air circulation loop has two vertical air channels in the region below the work station, above which the space that houses the blower and the filter arrangement is connected with the air openings on both sides of the work station, then the equipment required for supplying heat to food such as a cook top or a grill plate can be conveniently housed in the space between the vertical air channels, together with the electric current supply and its accompanying controls.

If, in a further embodiment of the air extraction apparatus of the invention, the space in which the blower and the filter apparatus are housed is located beside the work station, then the path which the air loaded with grease and odors has to follow is minimized, starting from the downstream air opening of the work station to the filter apparatus, so that the possibility that the air extraction apparatus can be dirtied by grease is also minimized.

If, in a further embodiment of the air extraction apparatus of the invention, the grease separating filter and the odor filter are inclined from the vertical, then technological benefits of construction and flow arise, because the space between the two filters which houses the blower can be well used, or because the filtering effect is especially good in such a configuration.

If, in a further embodiment of the air extraction apparatus of the invention, the grease separating filter is inclined from the vertical by an angle of 40–50°, preferably 45°, and if, in a still further embodiment of the air extraction apparatus of the invention, the odor filter is inclined from the vertical by an angle of 30–40°, preferably 35°, especially great technological benefits accrue in construction and in air flow, as has been demonstrated by means of a prototype.

If, in a further embodiment of the air extraction apparatus of the invention, the space in which the blower and the filter apparatus are housed, is divided by the two filters into a pre- and post- (blower) chamber, then the space available below the work station or alongside the work station is especially well used.

If, in a further embodiment of the air extraction apparatus of the invention, the air outlet is located in a wall of the post-(blower) chamber, odor and grease-free air can be ejected into the ambient, because this air has already flowed through the entire filter apparatus.

If, in a further embodiment of the air extraction apparatus of the invention, the work station is a grill, which is located above the space in which the blower and filter apparatus are housed, or which extends alongside that space, the technological flow advantages achieved by the invention manifest themselves because the air curtain covers the whole region above the grill, so that, also during grilling, neither odors nor grease reach the surrounding space.

If, in a further embodiment of the air extraction apparatus of the invention, the air outlet is so formed or adjusted that 75% of the air is extracted from the air circulation loop and the remaining 25% reach the work station as ambient air and form its air curtain, then the space surrounding the work station is especially effectively protected from odors and grease, since tests have shown that such an air curtain, which contains only 25% of the air originally drawn into the air circulation loop, can be completely drawn into the air opening on the downstream side of the work station, without causing an air blockage to form in front of this air opening.

If, in a further embodiment of the air extraction apparatus of the invention, there is provided at least one air intake for drawing in ambient air into the air circulation loop for replacing the air which escapes from the air circulation loop into the surroundings via the air outlet, the supplementation by room air to replace the air escaped via the air outlet can be controlled as required by the location of this air intake. Through this air intake, the air volume flowing into the grease filter is increased. This reduces the fume density and simultaneously lowers the air temperature, both of which are important for the optimum efficiency of the odor filter. The reduction in fume density prevents quick saturation of the odor filter. Thus, the air intake effects a reduction in fume density, and an associated temperature reduction of the unfiltered air, which is again important for the operation of the odor filter, especially when this involves a zeolite filter.

If, in a further embodiment of the air extraction apparatus of the invention, the air intake is the air opening on the downstream side of the work station, then it follows that the cleansed air curtain covers the entire work station, so that no uncleansed ambient air reaches the food on the work station, and yet the extracted air can be replaced by fresh ambient air.

If, in a further embodiment of the air extraction apparatus of the invention, the air intake is an additional air opening positioned downstream from the air opening on the downstream side of the work station and upstream from the blower, then the exhausted air in the air circulation loop can be controllably replaced as needed, without detriment to the air curtain and its functioning above the work station. The secondary air drawn in by the additional air opening has the effect of significantly increasing the air volume to be treated by the filters, which is loaded with fumes and odors. That is because the volume of air flowing to the grease filter is increased by the air opening. The fume density is thereby reduced. At the same time, the air temperature is lowered. Both components are quantities which determine the optimum effectiveness of the zeolite filter. The reduction in fume density prevents rapid saturation of the zeolite filter. Thus, for heavy fume/odor incidence, the filter operation of the zeolite filter is optimized. Simultaneously, the resulting air quantity increase leads to a temperature reduction of the air extracted from the work station, which is also advantageous for the optimal operation of the zeolite filter. These advantages prevail overall in the previously mentioned further embodiment of the air extraction apparatus of the invention, in which there is provided at least one air intake for drawing ambient air into the air circulation loop to replace the air which escapes via the air outlet from the air circulation loop into the surroundings.

If, in a further embodiment of the air extraction apparatus of the invention, it is integrated into a kitchen work station to form a kitchen module, that module can be inserted into a modular kitchen equipment suite such as the varithek®-System, known from German patent DE 197 57 004 A1.

If, in a further embodiment of the air extraction apparatus of the invention, the two air openings are so located relative to each other that an air flow axis which symbolizes the air curtain is inclined slightly downward from the horizontal with respect to the downstream air opening, then the slightly downward directed air flow better counteracts a heat flow which forms above the work surface than would, for example, a horizontal air flow. With the latter, there is the risk that the heat flow carries grill and cooking vapors beyond the effectiveness range of the downstream air opening, so that these vapors cannot be, or can only be partially encompassed.

If, in a further embodiment of the air extraction apparatus of the invention, the upstream air opening takes the form of a narrow outlet slot and the oppositely located downstream air opening takes the form of a substantially wider suction slot, then the encompassing effect, i.e. the effect that the downstream air opening encompasses the supplied air as completely as possible, can be optimized. In so doing, the outlet slot is preferably made narrower for a wide spacing between upstream and downstream air openings, than for a small spacing between the two air openings. The width of the suction slot is preferably made larger for a wide spacing between the air openings than for a small spacing.

If, in a further embodiment of the air extraction apparatus of the invention, the outlet slot and the suction slot are formed by air duct elements in the vertical air channels, then the air duct elements in the vertical air channel of the upstream air opening make it possible to concentrate and deflect the upwardly flowing air, the upward narrowing of the channel and the deflection being so configured that turbulence is prevented as much as possible and that the least possible pressure loss takes place. In the downstream air opening forming the suction slot and a vertical air channel connected thereto, the air is deflected by sheet metal guidance elements and the encompassing effect of the suction slot is substantially improved by this flow optimizing configuration.

If, in a further embodiment of the air extraction apparatus of the invention, the outlet slot is inclined slightly downward from the horizontal, and the suction slot is provided with radii on its facing internal walls, then the encompassing effect of the downstream air opening forming the intake slot can be optimized, preferably by radii at the upper and lower edge of the intake slot.

If, in a further embodiment of the air extraction apparatus of the invention, a section of the vertical air channel which extends from the downstream air opening is covered upwardly by an air guiding element, then the encompassing effect of the downstream air opening can be optimized from the current flow technology standpoint. Preferably, the air guiding element is formed with a small working surface, or at a short distance between the upstream and downstream air opening, as a radius on the upper edge of the downstream air opening. For a large working surface, or a wide spacing between the air openings, the air guiding element is preferably S-shaped at the transition from the downstream air opening to the vertical channel.

If, in a further embodiment of the air extraction apparatus of the invention, the covering upper air guiding element is increasingly foreshortened with increasing size of the working space, and therefore increasing distance between the upstream and downstream air openings, then part of the encompassing effect of the downstream air opening is thereby deflected upwardly and optimized. This is due to the creation of an increasing quantity of vapors due to an increasing distance between the upstream and the downstream air opening, as well as the upward heat flow of the upwardly deflected air stream of the upstream air opening.

If, in a further embodiment of the air extraction apparatus of the invention, the air guiding element has an S-shaped cross-section, then this has the advantage that, for a greater distance between the upstream and downstream air openings, the transition from the downstream air opening to the vertical channel is optimized from the flow technology standpoint. Especially improved is the encompassing effect of the downstream air opening.

If, in a further embodiment of the air extraction apparatus of the invention, the work station above the air openings is surrounded on three sides, not including its operator side, by an air guiding wall, especially a splash guard, which increases in height from the operator side in the direction transverse to the air curtain and toward the opposite side of the work station, there is produced an air flow (outlet stream) which moves in a stable whirling pattern from the air opening on one side to the air opening on the other side of the work station. This is associated with a lengthening of the air path. This again increases the take-up capacity for the fumes to be transported away. In this regard, the air guiding wall plays an important role. In a further embodiment of the invention this consists of a U-shaped rim-encircling metal sheet which serves as a splash guard for grilling but, in this embodiment of the invention, has the additional effect that the above-mentioned whirling flow is reliably stable. Only the geometric configuration of the air guiding wall or the splash guard according to the above-described embodiment of the invention, leads to the optimum whirling flow. In so doing, the increasing height of the guiding wall in the rear of the work station away from the operator side plays a special role. This means that its shape decisively affects the aerodynamics.

Illustrative embodiments of the invention are described in more detail in what follows with reference to the accompanying drawing.

There is shown by

Figure 2:
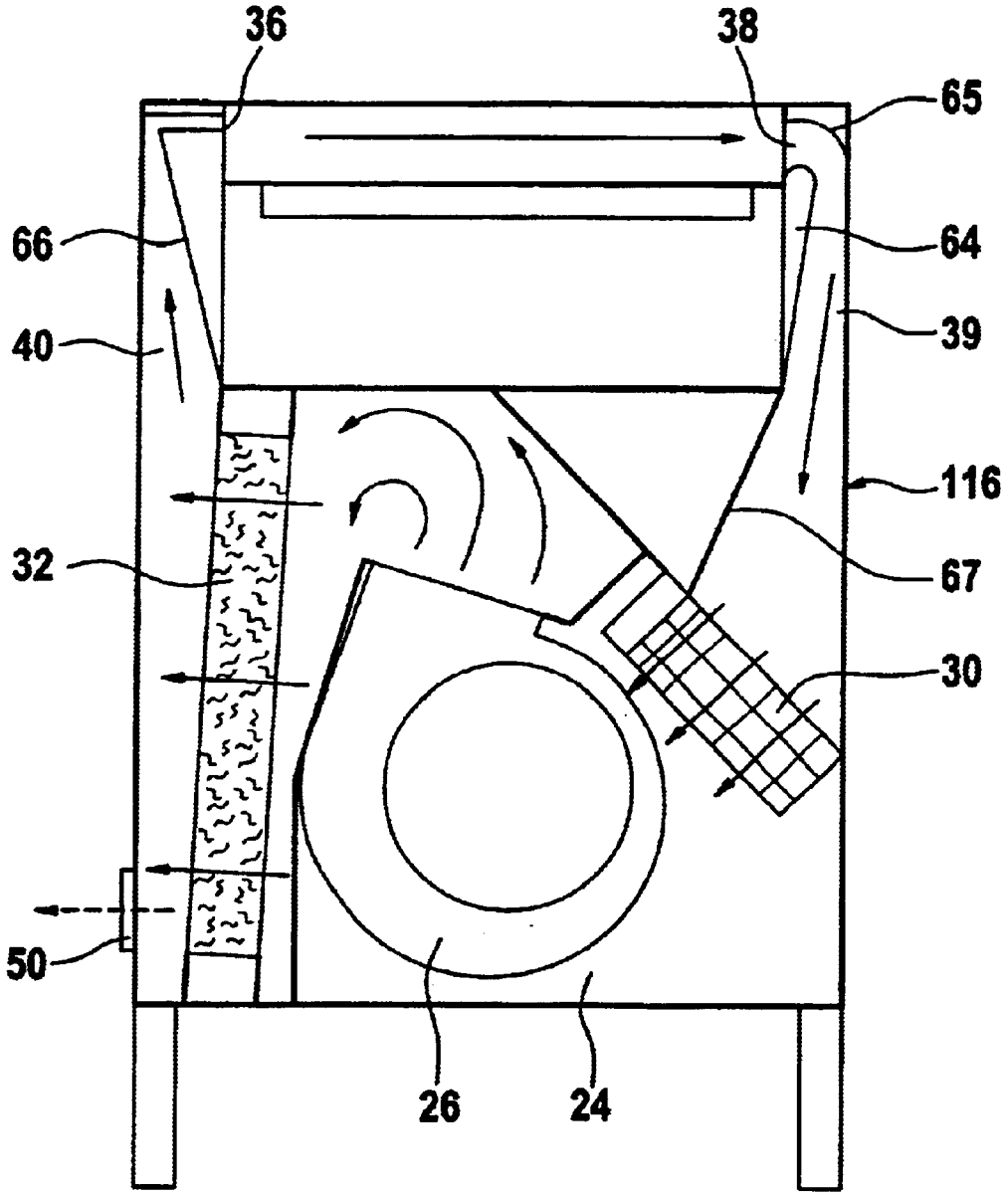
Figure 3:
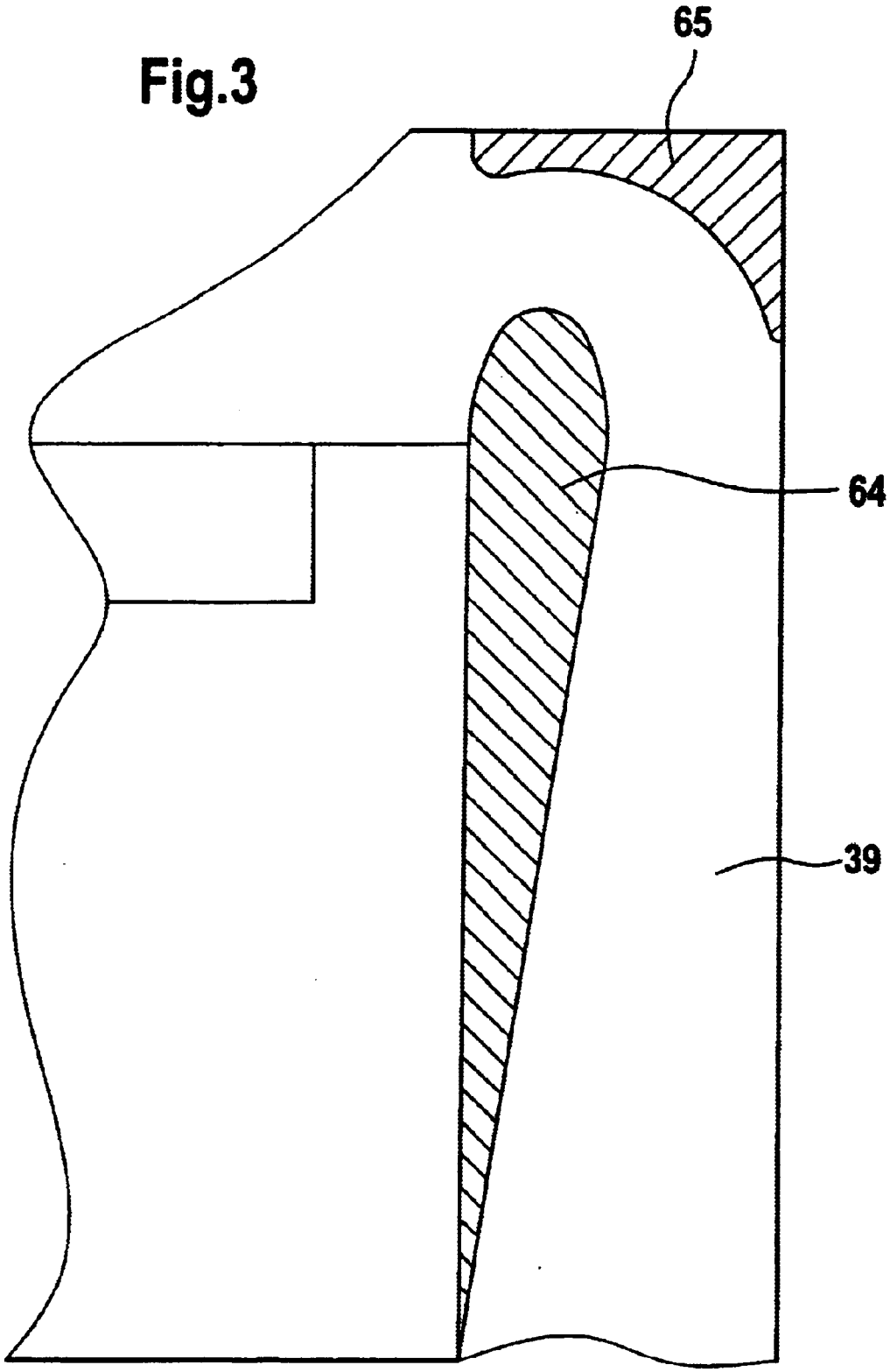
Figure 4:
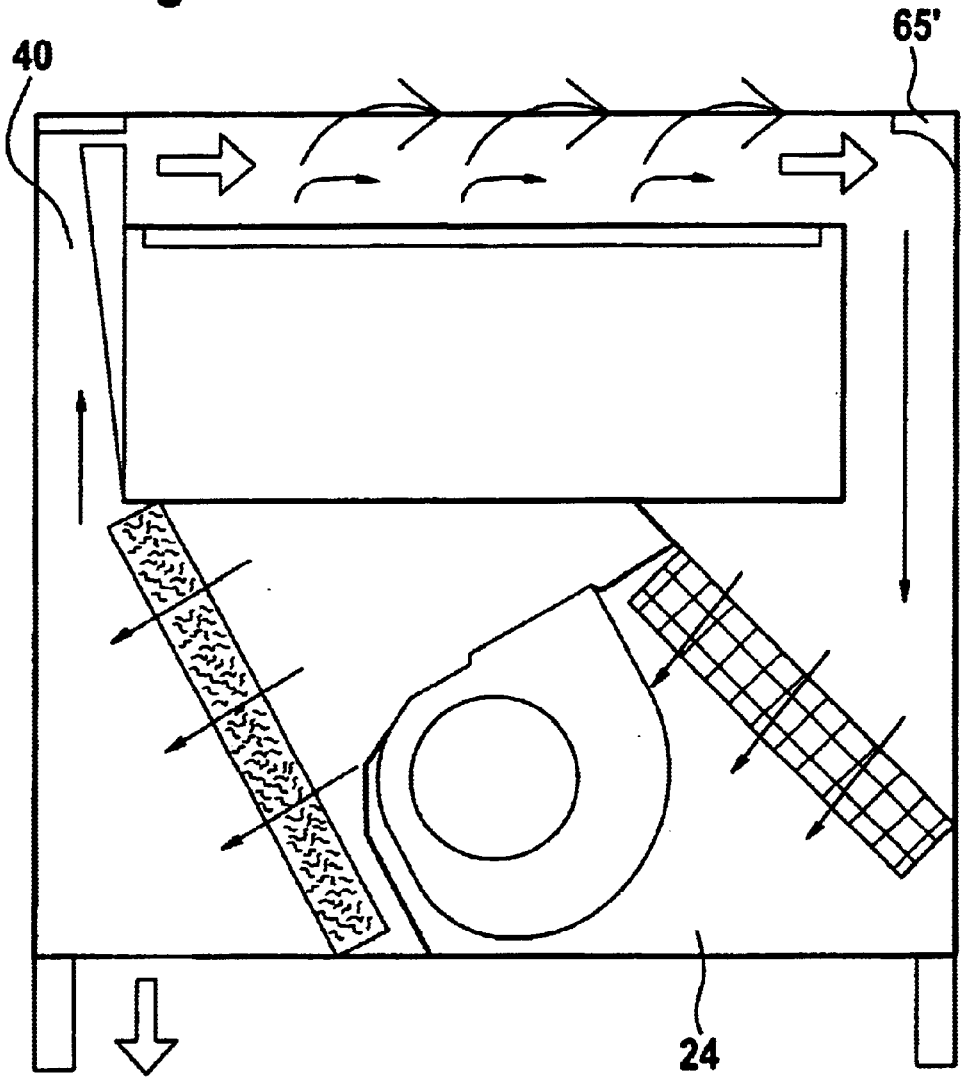
Figure 5:
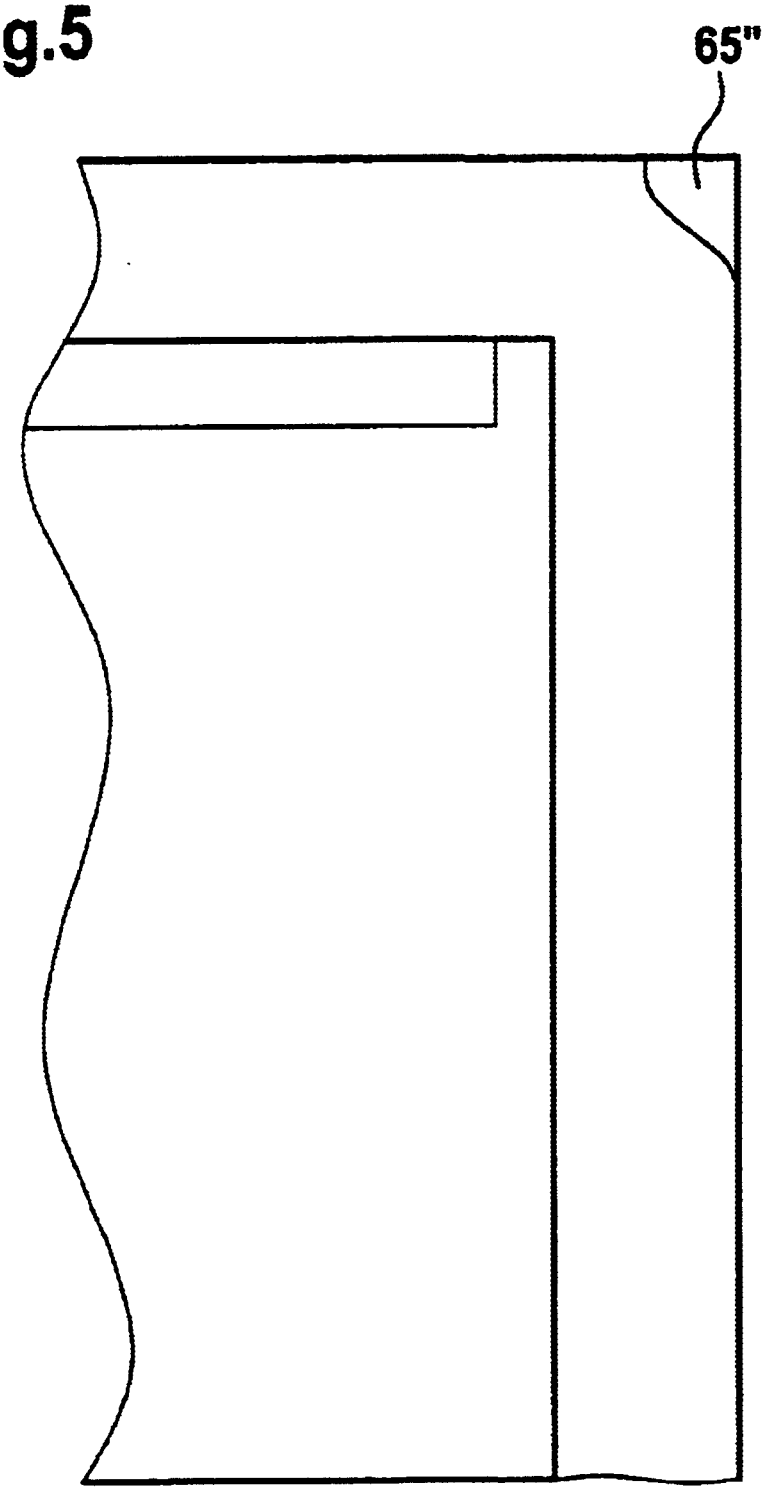
Figure 6:
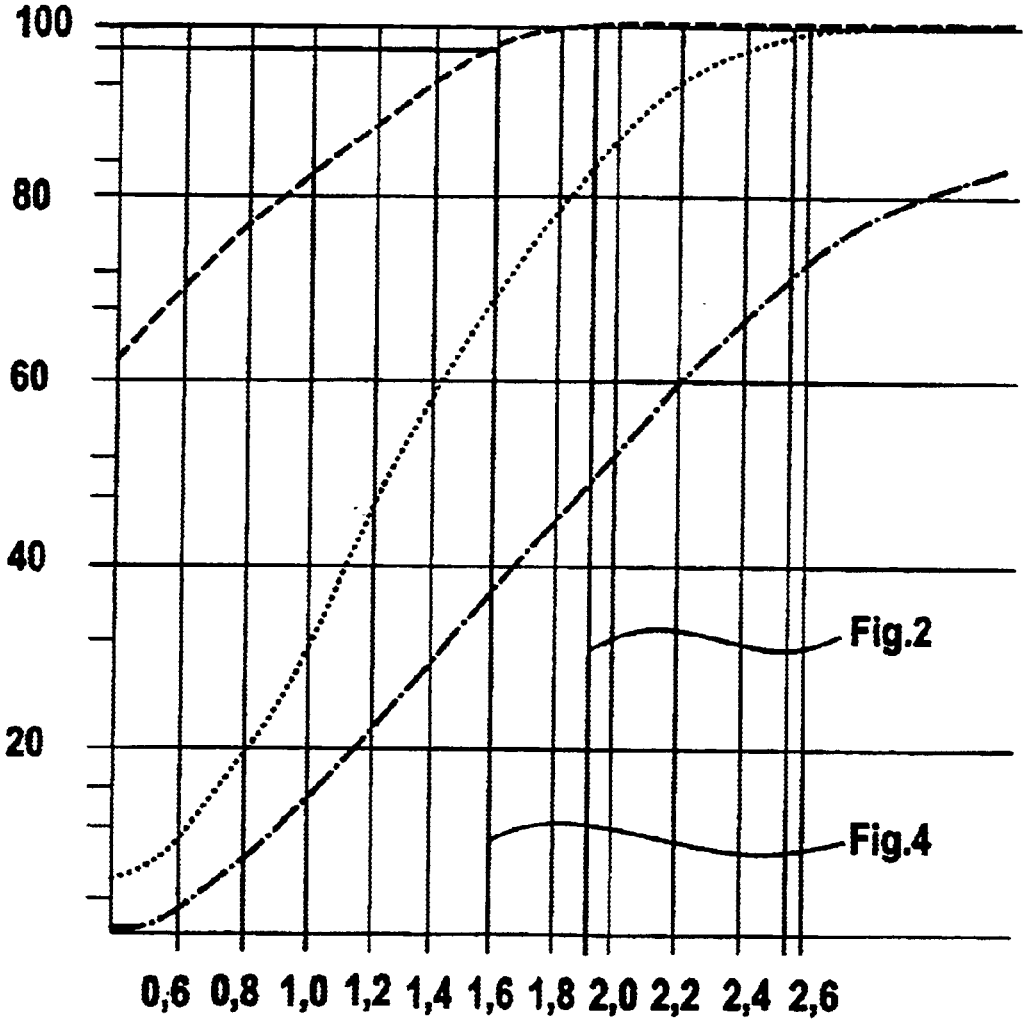
Figure 7:
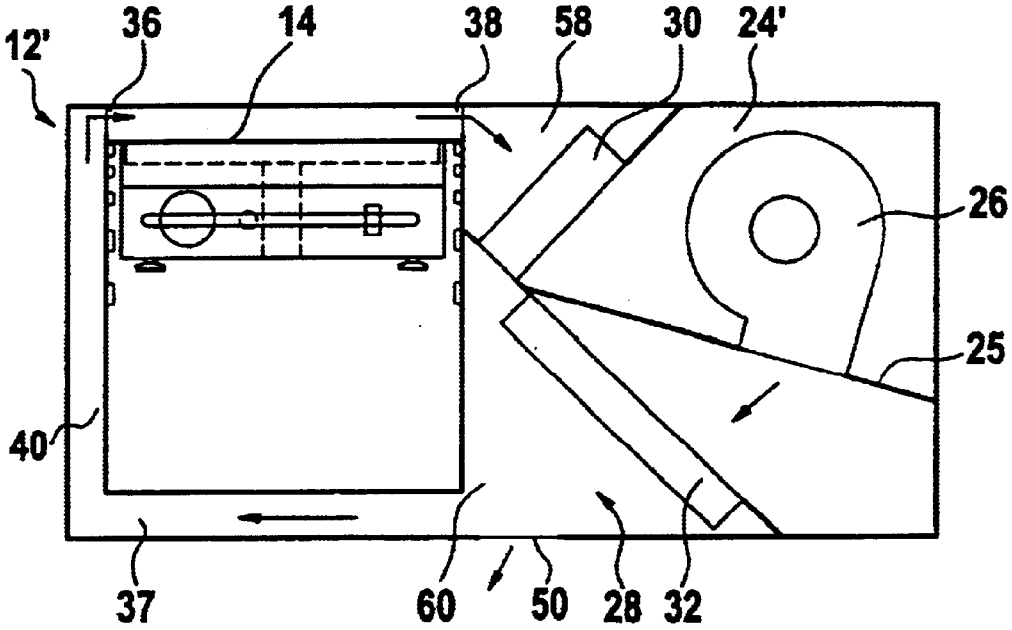
Figure 8:
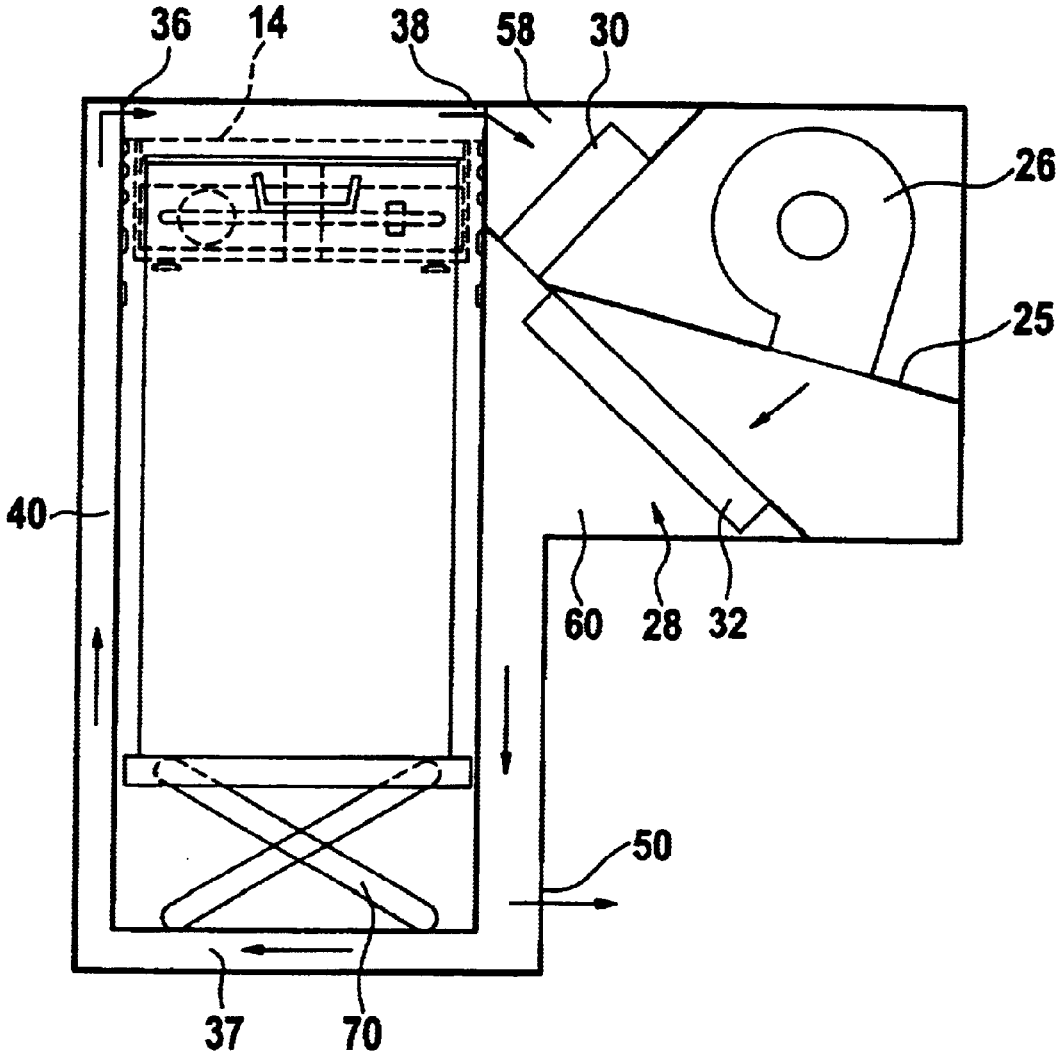
Figure 9:
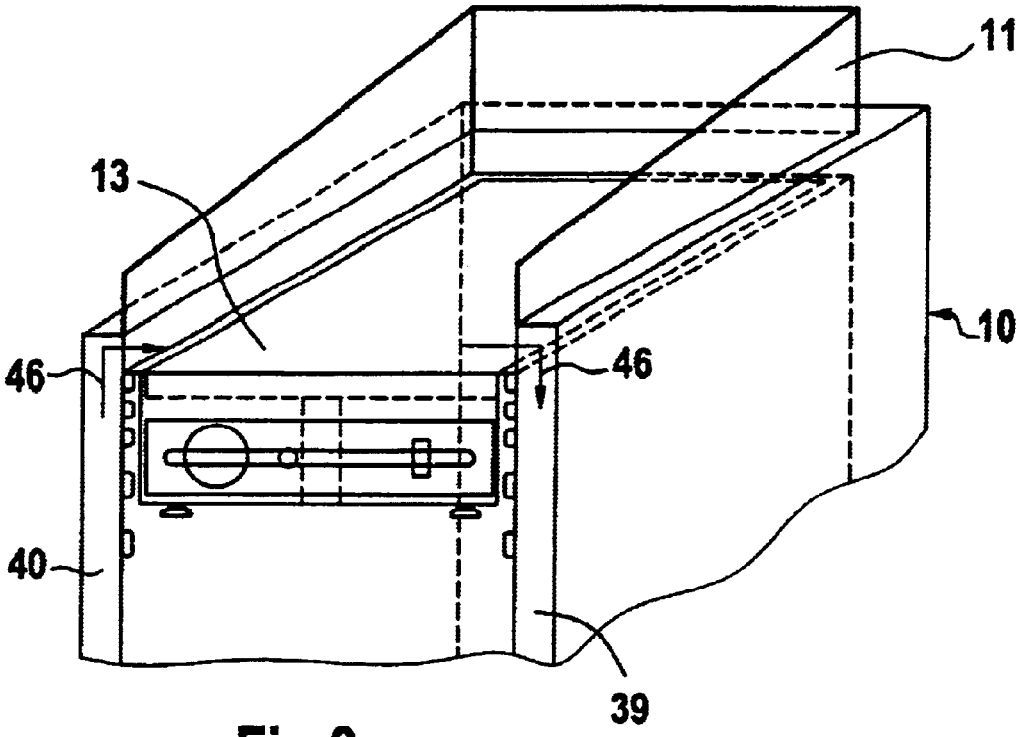

FIG. 1 a basic sketch of a kitchen module with integrated air extraction apparatus of the invention, FIG. 2 a practical illustrative embodiment of the kitchen module of FIG. 1, FIG. 3 a detail of the kitchen module of FIG. 2, FIG. 4 a further practical illustrative embodiment of the kitchen module of FIG. 1, but in which the work station is substantially longer, FIG. 5 a detail of a modification of the illustrative embodiment of FIG. 4, FIG. 6 a diagram showing the separating effect of a cyclone filter, FIG. 7 a further illustrative embodiment in which the space which houses a blower and a filter apparatus is located beside the work station, FIG. 8 a modification of the illustrative embodiment of FIG. 7, in which an apparatus which subjects food to heating, e.g. a grill, a cooking surface or the like, is adjustable in height, and FIG. 9 in a partial perspective view from above, a modified embodiment of the kitchen module with integrated air extraction apparatus of FIG. 1, in which a splash guard is additionally applied to the kitchen module above the work station.

FIG. 1 shows a kitchen module generally designated by reference numerical 10 with an air extraction apparatus generally designated as 12. The air extraction apparatus 12 is located in a work station 14 in which food is subjected to heating. Such a work station can be a grill, a cooktop or the like, i.e. a work station in which there are created fumes loaded with odors and grease which must be drawn away with the air from the vicinity of the work station, if the surroundings of the kitchen module 10 are not to be adversely affected. The work station 14, in this case an electric grill plate, is inserted in a housing 16 and rests therein on supports 18 formed on the inner walls of the housing. The housing encloses a superstructure 20 and a substructure 22, between which there is provided an intermediate structure 23 for containing control devices, for example an electrical power supply or the like. The substructure 22 includes an enclosed space 24 in which there are housed a blower 26, in this case a centrifugal blower, and a filter arrangement 28 generally designated by reference numeral 28 and consisting in this case of a grease separating filter 30 and an odor filter 32. The kitchen module 10 can be moved on pivoting rollers 34. On both sides of work station 14, air openings are provided, namely an upstream air opening 36 and a downstream air opening 38. From the downstream air opening 38, a vertical air channel 39 leads into the enclosed space 24. From enclosed space 24, a vertical air channel 40 leads to the upstream air opening 36. The air openings 36, 38, the blower 26, the filter arrangement 28 and a region 42 located between the air openings and immediately above the work station 14 constitute a closed air circulation loop which produces, during operation of the air extraction apparatus 12, an air curtain 44 in the region 42 between the air opening 36 and the air opening 38 of the work station 14. The air circulation loop is represented by air curtain arrows 46 shown in solid lines and by short arrows which indicate air curtain 44 and is designated in the drawing and in what follows generally by reference numeral 48.

The air circulation loop 48 has an air outlet 50 which allows a portion 52 of the air represented as a dashed arrow to exit from the air circulation loop. The air outlet 50 has an opening whose size is adjustable. The adjustability of this opening is indicated by a two-way arrow 54 shown adjacent to the air outlet 50. The air outlet 50 is located downstream from the blower 26.

The illustrated grease separating filter 30 is preferably a cyclone filter. The illustrated odor filter 32 is preferably a zeolite filter. Of course, the filter arrangement can have more than one grease separating filter and more than one odor filter. Preferably the blower 26 is located between at least two filters of the filter arrangement 28, consisting preferably of one grease separating filter, such as grease separating filter 30 upstream from the blower 26, and one odor filter, such as odor filter 32 downstream from the blower 26. Beneath grease separating filter 30, a grease collecting pan 56 is located. When the kitchen module 10 is in use, the front of the enclosed space is closed by a door, which has been omitted in FIG. 1 in order to make the interior of the enclosed space 24 visible.

As shown in FIG. 1, the grease separating filter 30 and the odor filter 32 are positioned inclined with respect to the vertical air channels 39 or 40. The grease separating filter 30 is inclined with respect to the associated vertical air channel 39 by an angle of 40°–50° and preferably 45°. The odor filter 32, as shown, is inclined by an angle of 3°–5° with respect to die associated vertical air channel 40.

The air channels 39 and 40 are connected at their opposite ends relative to the work station 14 to an entry chamber 58 and an exit chamber 60, respectively, which are separated inside enclosed space 24 by the two filters 30, 32, i.e. by partitions to which these filters are attached, as shown in FIG. 1. The air outlet 50 is located in a bottom wall of exit chamber 60. The blower 26 is attached to an intermediate partition 62, so that its upstream side is in communication with the downstream side of the grease separating filter 30 and its downstream side is in communication with the upstream side of the odor filter 32.

The air outlet 50 is adjustable by a fixed or adjustable opening diaphragm or the like so that 75% of the air from the air circulation loop 48 can be allowed to escape through the air outlet 50 and the remaining 25% reaches the work station 14 as ambient air and forms its air curtain 44. The downstream air opening 38, into which the air curtain extends due to the suction effect of blower 26, also serves simultaneously as an air intake for drawing ambient air into the air circulation loop to replace the air which was allowed to escape into the ambient from the air circulation loop through the air outlet 50. The air intake could also consist of an air opening 63, which is additionally provided on the downstream side of the work station 14, e.g. in the region of the vertical air channel 39 or, as indicated for 63 by dashed lines, in the region of entry chamber 58. It will be appropriate for the air intake 63 to be provided at least upstream of the grease separating filter 30, so that ambient air free of grease as well as of odor reaches the air curtain 44 via air channel 40. The secondary air drawn in by the additional air opening 63 has the effect that the air volume loaded with fumes and odors to be processed by the filters is significantly increased. In turn, this has the effect that, in the presence of strong fumes/odor, the filtering effect of the zeolite filter is optimized. Simultaneously, the so-created increased air quantity leads to a temperature decrease of the air drawn away from the work station, which is also advantageous for optimal operation of the zeolite odor filter 32.

The filter arrangement 28 of the cyclone grease separating filter 30 and the zeolite odor filter 32 forms a filter structure which can be regenerated without any problem: The grease separating filter is cleansed in a dishwasher; the zeolite odor filter 32 is desorbed at 200° C. in a baking oven or in a combination baking oven-and-steamer.

In FIGS. 2 to 5, there are shown practical illustrative embodiments of the air extraction apparatus of the invention generally described above which, instead of housing 16 which consists of superstructure, substructure and intermediate structure, have a so-called system support 116 which has an enclosed space 24 at the bottom and, above it, separated therefrom, the work station 14 which consists in this case of an electric grill plate. FIG. 2 shows diagrammatically the construction of the system support 116 with a relatively small or short work station 14. In what follows, the structural details which correspond to the embodiment of FIG. 1 are not described again. Similar parts are provided in FIGS. 2 to 5 with the same reference numerals as in FIG. 1. The air path is again illustrated by arrows. The differences between the embodiments of FIGS. 2 and 3 and the embodiment of FIG. 1 are described in more detail in what follows.

In the vertical air channels 39 and 40, there are located air guiding elements 64, 65 or 66 in FIG. 2. The air guiding element 66 is a piece of sheet metal which extends diagonally upward, and bends horizontally at the top, so that air opening 36 takes the form of a blower outlet slot. Air guiding element 66 forms an angle of preferably 13.7° with the vertical. Air guiding elements 64 and 65 are so configured that the air opening 38 takes the form of a suction slot whose open cross-section is substantially larger than that of the blower slot of air opening 36.

In the vertical air channel 40, which narrows vertically because of air guiding element 66, the upwardly flowing air is concentrated and deflected approximately horizontally. The upward narrowing of air channel 40 and the deflection are so configured for the benefit of the flow path that turbulence is prevented as much as possible and the least possible pressure drop occurs. The outlet slot of air opening 36 is tilted slightly downwardly from the horizontal so that the air curtain, i.e. the axis of a flow which exits from air opening 36, impinges on the lower edge of the downstream air opening 38. Experiments have shown that an air stream flow from air opening 36 which is directed slightly toward the bottom is better than a horizontal air flow from this opening. The downwardly directed air flow is better for the heat flow forming above the work station. With a horizontal air stream, there is the risk that the heat flow can carry grill and cooking vapors beyond the effectiveness range of the downstream air opening 38, so that these vapors can either not be carried away at all, or only partially. The air channel 40 is made increasingly wider in the direction toward the grease separating filter 30 by means of an additional air guiding element 67, as shown in FIG. 2.

In the illustrative embodiment shown in FIG. 4, in which the work station is longer than in the illustrative embodiment of FIG. 2, the blower slot of the upstream air opening 36 is less steeply inclined because of the greater spacing between the upstream air opening 36 and the downstream air opening 38. Air flowing out from the upstream air opening 36 has the property of inducting air from the ambient. The inducted air volume increases strongly with the flow length and depends upon the flow's density, among other factors. In order to be able to extract the vapor-laden air flow as completely as possible on the other side via the downstream air opening 38, the upstream air opening 36 is made smaller for a system carrier with a relatively large work station, as shown in FIG. 4, than for a system carrier with a relatively small work station, as shown in FIG. 2. In any case, the downstream air opening 38 functions to entrain the air supplied by the upstream air opening 36 as completely as possible and to lead it away downwardly via the vertical air channel 39.

In FIG. 3, there is shown, in isolation and in cross-section, such a downstream air opening 38 having the form of a suction slot. In this, the lower and upper edges of the suction slot are provided with radii. Within the downstream air opening 38, the air is deflected by the air guiding elements 64, 65, which are sheet metal guides. By this flow-optimized configuration, the entrainment effect of the downstream air opening 38 is substantially enhanced.

In the system support illustrated in FIG. 4, substantially more fumes arise, due to the larger work surface of the work station 14. In addition, the heat flow which occurs due to the longer path deflects the air stream of the upstream air opening 36 more strongly upwardly. Therefore, the downstream air opening 38 is conformed in its shape and orientation to this property. The sideways oriented suction slot of the downstream air opening 38 of FIG. 2 is only partially adapted for this. Desirably, the downstream air opening 38 in FIG. 4 is so configured that a portion of the entrainment effect is deflected upwardly. In so doing, the width of the air guiding element 65' is halved, relative to the air guiding element 65 in FIG. 3.

FIG. 5 shows an optimized illustrative embodiment in which the transition from the downstream air opening 38 to the vertical air channel 39 is optimized from the flow technology standpoint by an S-shaped air guiding element 65". On the opposite side, no intrusions prevent the inflow of the air to be extracted. Overall, the downstream air opening 38 of a system support having a large work surface as illustrated in FIG. 5 is formed as a kind of suction channel, which remains unchanged in its length relative to the downstream air opening 38 of FIG. 3 and FIG. 4, whereas its width is doubled relative to the downstream air opening 38 of a system support having a small work surface, and its surface is enlarged by more than twice relative to same. Such a suction channel is oriented sideways and upwardly.

In the system carrier with the largest work station, as shown in FIG. 4, the odor filter 32 forms an angle of 30°–40°, preferably 35°, with the vertical air channel 40, or of 60° with the bottom of the enclosed space 24.

In the illustrative embodiment of FIG. 2, the odor filter 32 is positioned substantially more steeply than in the illustrative embodiment of FIG. 4. Therefore, in the illustrative embodiment of FIG. 2, the air outlet 50 is not located at the bottom of the enclosed space 24, but in its left sidewall. The angle which the air filter 32 forms with the vertical in the illustrative embodiment of FIG. 2, amounts to 2° to 10°, preferably 3°. The air outlet 50 is provided with a commercial type of ventilating grille, having leaves which are slidable relative to each other. By so changing the outlet cross-section, the outlet air quantity can be adjusted.

In all illustrative embodiments, the blower 26 is so arranged that it does not cover any part of the filter surface. For a blower, it is appropriate to use a two-sided suction centrifugal fan, which can be readily built into the system support. This arrangement is so selected that blower 26 does not blow directly on the following odor filter 32. Thus, a pressure space is formed in front of the odor filter, which leads to uniform flow through the odor filter. The separating capacity of the grease separating filter depends on the in-flow velocity of the air stream to be cleansed. To determine the separating capability of the grease separating filter, the performance diagram provided by the manufacturer is utilized. Using the measured air stream and the filter surface, one calculates the average in-flow velocity and determines the separating capability of the grease filter by means of the performance diagram. FIG. 6 illustrates the average in-flow velocities and the accompanying separating capabilities. For the system support with a smaller work station (FIG. 2), the average in-flow velocity is 1.9 m/s. This yields a separating capability of 98%. For the system carrier with the larger work station (FIG. 4), the average in-flow velocity of the grease separating filter is 1.6 m/s and the separating capability is 96%. It should further be noted that, in practical investigations using water vapor and baking grease and subsequent evaluation of the components, no dirtying could be observed on the components which follow the grease separating filter. In FIG. 6, there are drawn three curves for various particle sizes. The lower (dot-dash) curve applies to a particle size of 1.0 to 3.0 $\mu$m, the middle (dotted) curve applies to a particle size of 3.0 to 5.0 $\mu$m and the upper (dashed) curve applies to a particle size of 5.0 to 10.0 $\mu$m.

FIG. 7 shows an air extraction apparatus, collectively designated as 12', in which the space 24', in which the blower 26 and the filter arrangement 28 are housed, is located beside and next to the work station 14. The space 24' is subdivided by a partition inclined from the horizontal. Above the partition 25, there is located the blower 26, whose outlet pipe stub extends through the partition 25. Upstream from blower 26 the grease separating filter 30 is located. Downstream from blower 26 the odor filter 32 is located. In space 24' the inlet chamber 58 and the outlet chamber 60 is subdivided by the two filters 30, 32. The downstream air opening 38 forms the direct entrance to the inlet chamber 58. The air laden with grease fumes and odor from the region above work station 14 therefore reaches the space 24' via the shortest path and thereby has minimal opportunity to soil the air extraction apparatus with grease, smoke particles, or the like.

In space 24', the air arrives first at the grease separating filter 30 and is freed of grease particles therein. Through the suction effect of blower 26, the air is drawn through the grease separating filter 30. Thereafter, the air freed of grease particles, is pushed by means of blower 26 through the odor filter 32, which involves a zeolite filter. Finally, the air reaches the vertical air channel 40 via a horizontal air channel 37 and from there the upstream air opening 36.

The lateral positioning of space 24', which contains the blower 26 and the filter arrangement 28, has the advantage that filters and blower are easily accessible and further that no equipment is present in the region below the work station. The latter region can therefore be used in other ways. Such a possible additional use is shown by the illustrative embodiment of FIG. 8.

In the illustrative embodiment of FIG. 8, a device 70 is located below the work station 14, on which there rests a container in the illustrated example. The top opening of the container can be raised to an optimum height by means of the device 70, so that the air filter can optimally carry away odors and vapors which escape from the container.

The range of application of the above-described air extraction apparatus is not limited to a work station on which food is supplied with heat, but also encompasses applications such as welding and soldering, mixing of chemicals, working with galvanic baths and the like.

In the illustrative embodiment of FIG. 9, the work station 14 is surrounded by an air guide partition on three sides above the air openings 36, 38, but not including the operator's side 13, in the form of a splash guard 11. The splash guard 11 increases in height starting from the operator's side 13 in a direction transverse to the air curtain 44 (illustrated in FIG. 1) and toward the oppositely located side of the work station. The splash guard 11 consists of a U-shaped rim-surrounding metal sheet which forms an aerodynamic air-guiding sheet and establishes a stable, whirling flow above the work station 14. This is attributable to the special geometry of the air-guiding partition which rises toward the rear, i.e. of the splash guard 11 starting from the operator's side 13. The splash guard 11 can be simply placed on top of the top side of the kitchen module 10, which is shown in FIG. 1 in a partial perspective view, of course without covering up the air openings 36, 38 of the air channels 40 and 39. The air guiding partition or splash guard 11 can be provided not only in conjunction with the illustrative example of FIG. 1, but also for all other illustrative embodiments which are shown in the remaining figures. If the work station is not one where food is supplied with heat, which can lead to the splashing of grease, the air guiding partition performs only the function of an aerodynamic air-guiding device and can therefore confer its advantages on applications such as welding and soldering, mixing of chemicals, working with galvanic baths and the like.

What is claimed is:

1. An air extraction apparatus for a work station, especially one at which heat is supplied to food, having formed on both sides of the work station respective air openings which are connected to a blower and a filter arrangement, wherein the air openings (36, 38), the blower (26), the filter arrangement (28) and a region 42 located between the air openings (36, 38) and immediately above the work station (14), form a closed air circulation loop (48) which produces an air curtain (44) during operation of the air extraction apparatus (12) in the region between the air opening (36) on an upstream side of the work station (14) and the air opening (38) on a downstream side of the work station (14), the blower (26) and the filter arrangement (28) are housed in a space (24, 24') which lies within the air cin.ulation loop (48) and is connected to the air openings (36, 38) on both sides of the work station (14), the air circulation loop (48) includes an air outlet (50) for a portion (52) of the air from the air circulation loop (48), the air outlet (50) being located downstream from the blower (26) and the filter arrangement (28), the blower (26) is located between at least two filters (30, 32) of the filter arrangement (28), the filter upstream of the blower (26) being a grease separating filter (30) and the filter downstream of the blower (26) being an odor filter (32), and the air circulation loop (48) has at least one vertical air channel (40) in the region below the work station (14), through which at least one vertical air channel the space in which the blower (26) and the filter arrangement (28) are housed is connected to one of the two air openings (36, 38) on both sides of the work station (14).

2. An air extraction apparatus according to claim 1, wherein the air outlet (50) has an opening of adjustable size.

3. An air extraction apparatus according to claim 1, wherein the blower (26) is a centrifugal blower.

4. An air extraction apparatus according to claim 1, wherein the grease separating filter (30) is a cyclone filter.

5. An air extraction apparatus according to claim 1, wherein a grease collecting pan (56) is located beneath the grease separating filter (30).

6. An air extraction apparatus according to claim 1, wherein the odor filter (32) is a zeolite filter.

7. An air extraction apparatus according to claim 1, wherein the air circulation loop (48) has two vertical air channels (39, 40) in the region below the work station (14), above which the space in which the blower (26) and the filter apparatus (28) are housed is connected to air openings (36, 38) on both sides of the work station (14).

8. An air extraction apparatus according to claim 1, wherein a space (24') in which the blower (26) and the filter installation (28) are housed, is located beside the work station (14).

9. An air extraction apparatus according to claim 8, wherein the work station (14) is a grill which extends above the space in which the blower (26) and the filter arrangement (28) are installed or beside that space (24').

10. An air extraction apparatus according to claim 1, wherein the grease separating filter (30) and the odor filter (32) are positioned inclined with respect to the vertical (39, 40).

11. An air extraction apparatus according to claim 10, wherein the grease separating filter (30) is inclined with respect to the vertical at an angle of 40° to 50°, preferably of 45°.

12. An air extraction apparatus according to claim 10, wherein the odor filter (32) is inclined with respect to the vertical at an angle of 30° to 40°, preferably 35°.

13. An air extraction apparatus according to claim 10, wherein the space (24, 24') in which the blower (26) and the filter arrangement (28) are housed, is divided by the two filters (30, 32) into an entry and exit chamber (58, 60) respectively.

14. An air extraction apparatus according to claim 13, wherein the air outlet (50) is located in a wall of the exit chamber (60).

15. An air extraction apparatus according to claim 1, wherein the air outlet (50) is so-shaped or adjusted that 75% of the air is released from the air circulation loop (48) and the remaining 25% reach the work station (14) as ambient air and form its air curtain (44).

16. An air extraction apparatus according to claim 1, wherein at least one air intake (38, 63) is provided for drawing ambient air into the air circulation loop (48) to replace the air released into the surroundings through the air outlet (50) from the air circulation loop (48).

17. An air extraction apparatus according to claim 16, wherein the air opening (38) is on the downstream side of the work station (14).

18. An air extraction apparatus according to claim 16, wherein the air intake is an additional air opening (63) located downstream from the air opening (38) on the downstream side of the work station (14) and upstream of the blower (26).

19. An air extraction apparatus according to claim 1, wherein it forms a kitchen module (10) integrated into a kitchen work station.

20. An air extraction apparatus according to claim 1, wherein both air openings (36, 38) are so located relative to each other than an air flow axis symbolizing the air curtain (44) is inclined slightly downwardly with respect to the horizontal toward the downstream air opening (38).

21. An air extraction apparatus according to claim 1, wherein the upstream air opening (36) is formed as a narrow exit slot and the oppositely located downstream air opening (38) takes the form of a substantially broader intake slot.

22. An air extraction apparatus according to claim 21, wherein the exit slot and the intake slot are formed by air guiding elements (64–67) in the vertical air channels (39, 40).

23. An air extraction apparatus according to claim 22, wherein the exit slot is inclined slightly downwardly with respect to the horizontal and the intake slot is provided with radii located on its oppositely positioned inner walls.

24. An air extraction apparatus according to claim 21, wherein a segment of the vertical air channel which extends behind the downstream air opening (38) is covered upwardly by an air guiding element (65).

25. An air extraction apparatus according to claim 24, wherein for increasing size of the work station and resulting increasing spacing between the upstream and downstream air openings (36, 38), the covering upper air guiding element 65', 65") is increasingly shortened.

26. An air extraction apparatus according to claim 25, wherein the air guiding element (65") has an S-shaped cross-section.

27. An air extraction apparatus according to claim 1, wherein the work station (14) above the air openings (36, 38) is surrounded on three sides, not including its operator's side (13), by an air guiding wall, especially a splash guard (11), which increases in height starting from the operator's side (13) in a direction transverse to the air curtain (44) toward the opposite side of the work station.

28. An air extraction apparatus according to claim 27, wherein the air guiding wall (11) is a U-shaped edge-encircling metal sheet.

29. An air extraction apparatus for a work station, especially one at which heat is supplied to food, having formed on both sides of the work station respective air openings which are connected to a blower and a filter arrangement, wherein the air openings (36, 38), the blower (26), the filter arrangement (28) and a region 42 located between the air openings (36, 38) and immediately above the work station (14), form a closed air circulation loop (48) which produces an air curtain (44) during operation of the air extraction apparatus (12) in the region between the air opening (36) on an upstream side of the work station (14) and the air opening (38) on a downstream side of the work station (14), the blower (26) and the filter arrangement (28) are housed in a space (24, 24') which lies within the air circulation loop (48) and is connected to the air openings (36, 38) on both sides of the work station (14), the air circulation loop (48) includes an air outlet (50) for a portion (52) of the air from the air circulation loop (48), the air outlet (50) being located downstream from the blower (26) and the filter arrangement (28), the blower (26) is located between at least two filters (30, 32) of the filter arrangement (28), the filter upstream of the blower (26) being a grease separating filter (30) and the filter downstream of the blower (26) being an odor filter (32), and the air outlet (50) has an opening of adjustable size.

30. An air extraction apparatus for a work station, especially one at which heat is supplied to food, having formed on both sides of the work station respective air openings which are connected to a blower and a filter arrangement, wherein the air openings (36, 38), the blower (26), the filter arrangement (28) and a region 42 located between the air openings (36, 38) and immediately above the work station (14), form a closed air circulation loop (48) which produces an air curtain (44) during operation of the air extraction apparatus (12) in the region between the air opening (36) on an upstream side of the work station (14) and the air opening (38) on a downstream side of the work station (14), the blower (26) and the filter arrangement (28) are housed in a space (24, 24') which lies within the air circulation loop (48) and is connected to the air openings (36, 38) on both sides of the work station (14), the air circulation loop (48) includes an air outlet (50) for a portion (52) of the air from the air circulation loop (48), the air outlet (50) being located downstream from the blower (26) and the filter arrangement (28), the blower (26) is located between at least two filters (30, 32) of the filter arrangement (28), the filter upstream of the blower (26) being a grease separating filter (30) and the filter downstream of the blower (26) being an odor filter (32), and the air outlet (50) is so shaped or adjusted that 75% of the air is released from the air circulation loop (48) and the remaining 25% reach the work station (14) and form its air curtain (44).

31. An air extraction apparatus for a work station, especially one at which heat is supplied to food, having formed on both sides of the work station respective air openings which are connected to a blower and a filter arrangement, wherein the air openings (36, 38), the blower (26), the filter arrangement (28) and a region 42 located between the air openings (36, 38) and immediately above the work station (14), form a closed air circulation loop (48) which produces an air curtain (44) during operation of the air extraction apparatus (12) in the region between the air opening (36) on an upstream side of the work station (14) and the air opening (38) on a downstream side of the work station (14), the blower (26) and the filter arrangement (28) are housed in a space (24, 24') which lies within the air circulation loop (48) and is connected to the air openings (36, 38) on both sides of the work station (14), the air circulation loop (48) includes an air outlet (50) for a portion (52) of the air from the air circulation loop (48), the air outlet (50) being located downstream from the blower (26) and the filter arrangement (28), the blower (26) is located between at least two filters (30, 32) of the filter arrangement (28), the filter upstream of the blower (26) being a grease separating filter (30) and the filter downstream of the blower (26) being an odor filter (32), and the upstream air opening (36) is formed as a narrow exit slot and the oppositely located downstream air opening (38) takes the form of a substantially broader intake slot.

32. An air extraction apparatus for a work station, especially one at which heat is supplied to food, having formed on both sides of the work station respective air openings which are connected to a blower and a filter arrangement, wherein the air openings (36, 38), the blower (26), the filter arrangement (28) and a region 42 located between the air openings (36, 38) and immediately above the work station (14), form a closed air circulation loop (48) which produces an air curtain (44) during operation of the air extraction apparatus (12) in the region between the air opening (36) on an upstream side of the work station (14) and the air opening (38) on a downstream side of the work station (14), the blower (26) and the filter arrangement (28) are housed in a space (24, 24') which lies within the air circulation loop (48) and is connected to the air openings (36, 38) on both sides of the work station (14), the air circulation loop (48) includes an air outlet (50) for a portion (52) of the air from the air circulation loop (48), the air outlet (50) being located downstream from the blower (26) and the filter arrangement (28), the blower (26) is located between at least two filters (30, 32) of the filter arrangement (28), the filter upstream of the blower (26) being a grease separating filter (30) and the filter downstream of the blower (26) being an odor filter (32), the upstream air opening (36) is formed as a narrow exit slot and the oppositely located downstream air opening (38) takes the form of a substantially broader intake slot, and the exit slot and the intake slot are formed by air guiding elements (64–67) in the vertical air channels (39, 40).

33. An air extraction apparatus for a work station, especially one at which heat is supplied to food, having formed on both sides of the work station respective air openings which are connected to a blower and a filter arrangement, wherein the air openings (36, 38), the blower (26), the filter arrangement (28) and a region 42 located between the air openings (36, 38) and immediately above the work station (14), form a closed air circulation loop (48) which produces an air curtain (44) during operation of the air extraction apparatus (12) in the region between the air opening (36) on an upstream side of the work station (14) and the air opening (38) on a downstream side of the work station (14), the blower (26) and the filter arrangement (28) are housed in a space (24, 24') which lies within the air circulation loop (48) and is connected to the air openings (36, 38) on both sides of the work station (14), the air circulation loop (48) includes an air outlet (50) for a portion (52) of the air from the air circulation loop (48), the air outlet (50) being located downstream from the blower (26) and the filter arrangement (28), the blower (26) is located between at least two filters (30, 32) of the filter arrangement (28), the filter upstream of the blower (26) being a grease separating filter (30) and the filter downstream of the blower (26) being an odor filter (32), the exit slot and the intake slot are formed by air guiding elements 64–67) in the vertical air channels (39, 40), and the exit slot is inclined slightly downwardly with respect to the horizontal and the intake slot is provided with radii located on its oppositely positioned inner walls.

34. An air extraction apparatus for a work station, especially one at which heat is supplied to food, having formed on both sides of the work station respective air openings which are connected to a blower and a filter arrangement, wherein the air openings (36, 38), the blower (26), the filter arrangement (28) and a region 42 located between the air openings (36, 38) and immediately above the work station (14), form a closed air circulation loop (48) which produces an air curtain (44) during operation of the air extraction apparatus (12) in the region between the air opening (36) on an upstream side of the work station (14) and the air opening (38) on a downstream side of the work station (14), the blower (26) and the filter arrangement (28) are housed in a space (24, 24') which lies within the air circulation loop (48) and is connected to the air openings (36, 38) on both sides of the work station (14), the air circulation loop (48) includes an air outlet (50) for a portion (52) of the air from the air circulation loop (48), the air outlet (50) being located downstream from the blower (26) and the filter arrangement (28), the blower (26) is located between at least two filters (30, 32) of the filter arrangement (28), the filter upstream of the blower (26) being a grease separating filter (30) and the filter downstream of the blower (26) being an odor filter (32), the upstream air opening (36) is formed as a narrow exit slot and the oppositely located downstream air opening (38) takes the form of a substantially broader intake slot, and a segment of the vertical air channel which extends behind the downstream air opening (38) is covered upwardly by an air guiding element 65).

35. An air extraction apparatus for a work station, especially one at which heat is supplied to food, having formed on both sides of the work station respective air openings which are connected to a blower and a filter arrangement, wherein the air openings (36, 38), the blower (26), the filter arrangement (28) and a region 42 located between the air openings (36, 38) and immediately above the work station (14), form a closed air circulation loop (48) which produces an air curtain (44) during operation of the air extraction apparatus (12) in the region between the air opening (36) on an upstream side of the work station (14) and the air opening (38) on a downstream side of the work station (14), the blower (26) and the filter arrangement (28) are housed in a space (24, 24') which lies within the air circulation loop (48) and is connected to the air openings (36, 38) on both sides of the work station (14), the air circulation loop (48) includes an air outlet (50) for a portion (52) of the air from the air circulation loop (48), the air outlet (50) being located downstream from the blower (26) and the filter arrangement (28), the blower (26) is located between at least two filters (30, 32) of the filter arrangement (28), the filter upstream of the blower (26) being a grease separating filter (30) and the filter downstream of the blower (26) being an odor filter (32), the upstream air opening (36) is formed as a narrow exit slot and the oppositely located downstream air opening (38) takes the form of a substantially broader intake slot, a segment of the vertical air channel which extends behind the downstream air opening (38) is covered upwardly by an air guiding element 65), and for increasing size of the work station and resulting increasing spacing between the upstream and downstream air openings (36, 38), the covering upper air guiding element 65', 65") is increasingly shortened.

36. An air extraction apparatus for a work station, especially one at which heat is supplied to food, having formed on both sides of the work station respective air openings which are connected to a blower and a filter arrangement, wherein the air openings (36, 38), the blower (26), the filter arrangement (28) and a region 42 located between, the air openings (36, 38) and immediately above the work station (14), form a closed air circulation loop (48) which produces an air curtain (44) during operation of the air extraction apparatus (12) in the region between the air opening (36) on an upstream side of the work station (14) and the air opening (38) on a downstream side of the work station (14), the blower (26) and the filter arrangement (28) are housed in a space (24, 24') which lies within the air circulation loop (48) and is connected to the air openings (36, 38) on both sides of the work station (14), the air circulation loop (48) includes an air outlet (50) for a portion (52) of the air from the air circulation loop (48), the air outlet (50) being located downstream from the blower (26) and the filter arrangement (28), the blower (26) is located between at least two filters (30, 32) of the filter arrangement (28), the filter upstream of the blower (26) being a grease separating filter (30) and the filter downstream of the blower (26) being an odor filter (32), the upstream air opening (36) is formed as a narrow exit slot and the oppositely located downstream air opening (38) takes the form of a substantially broader intake slot, a segment of the vertical air channel which extends behind the downstream air opening (38) is covered upwardly by an air guiding element (65), and for increasing size of the work station and resulting increasing spacing between the upstream and downstream air openings (36, 38), the covering upper air guiding element (65', 65") is increasingly shortened, the air guiding element (65") has an S-shaped cross-section.

* * * * *